US005087328A

United States Patent [19]

Wegerer et al.

[11] Patent Number: 5,087,328

[45] Date of Patent: Feb. 11, 1992

[54] METHOD AND APPARATUS FOR REMOVING FILLING GASES FROM COKE OVENS

[75] Inventors: Johannes Wegerer; Wilhelm Kandler; Horst Panzer; Karl Buchberger, all of Linz, Austria

[73] Assignee: Voest-Alpine Stahl Linz Gasellschaft m.b.H., Linz, Austria

[21] Appl. No.: 577,876

[22] Filed: Sep. 5, 1990

[30] Foreign Application Priority Data

Sep. 7, 1989 [AT] Austria ..... 2095/89

[51] Int. Cl.[5] ..... C10B 27/04; C10B 43/14

[52] U.S. Cl. ..... 201/2; 201/27; 201/41; 202/263; 202/269

[58] Field of Search ..... 201/2, 26, 27, 40, 41; 202/263, 250, 251, 254, 269

[56] References Cited

U.S. PATENT DOCUMENTS 4,207,145 6/1980 Hatters et al. ..... 201/41
4,314,889 2/1982 Kuasuik et al. ..... 202/263
4,465,557 8/1984 Blase et al. ..... 202/263
4,673,463 6/1987 Kuasuik et al. ..... 201/41

FOREIGN PATENT DOCUMENTS 1105380 4/1961 Fed. Rep. of Germany ..... 202/263
3204991 12/1983 Fed. Rep. of Germany .
3806093 9/1989 Fed. Rep. of Germany ..... 202/263

*Primary Examiner*—Joye L. Woodard
*Attorney, Agent, or Firm*—Hopgood, Calimafde, Kalil, Blaustein & Judlowe

[57] ABSTRACT

A gas jumper arrangement for a coke oven is composed of adjacently arranged coke oven chambers each having a gas opening with rims at the top portion thereof. The gas jumper arrangement overlaps gas openings of two adjacent coke oven chambers by one lid chamber each. The two lid chambers are connected in a duct-like manner by a gas jumper pipe and lids covering the gas openings during filling of a coke oven chamber are displaceable from an opened position into a closed position and settable into a rotational movement within the lid chambers by an actuation device. In order to ensure the tightness of the gas openings at the rims thereof even at larger pressure fluctuations and to enable the introduction of inert gas into the gas jumper arrangment, both the lid and the rim of each gas opening includes valve-face type sealing surfaces that mate with each other when pressed against each other in the closed position of the lid. A feed line for supplying an inert gas runs into the gas jumper arrangement. An inert gas pressure prevails in the gas jumper arrangement with the lids closed which is in excess of the pressure prevailing in the coke oven chambers.

4 Claims, 2 Drawing Sheets

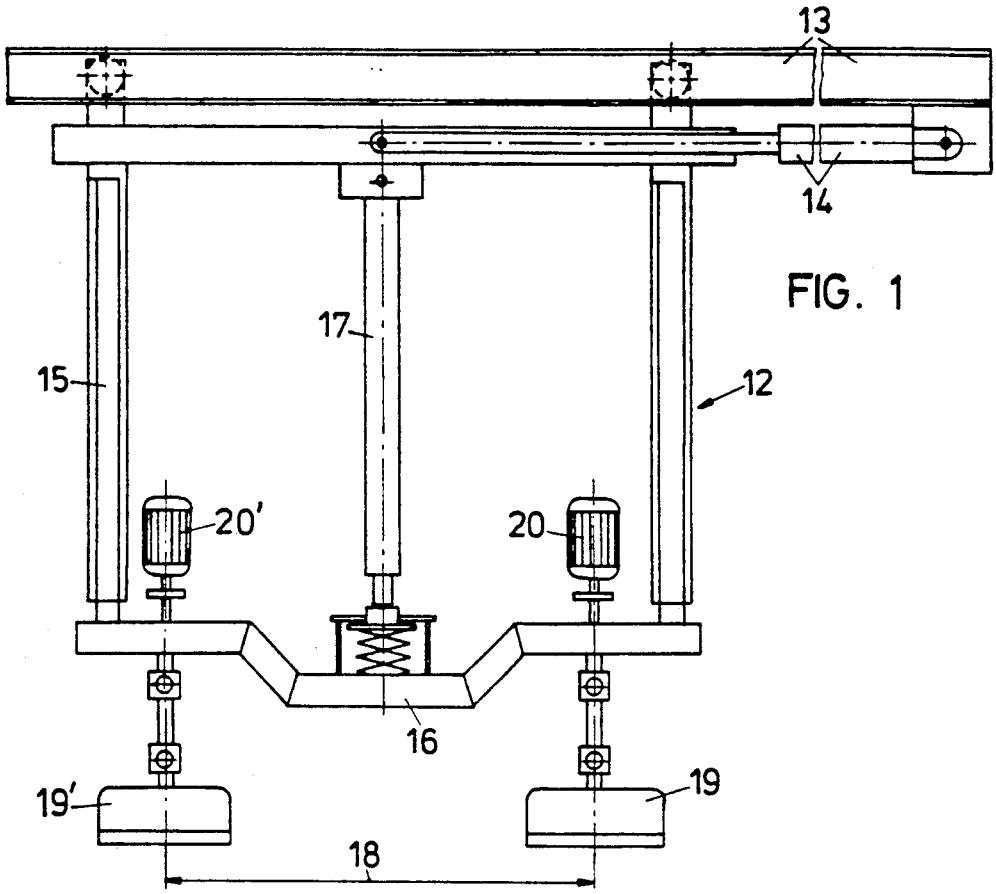
FIG. 1
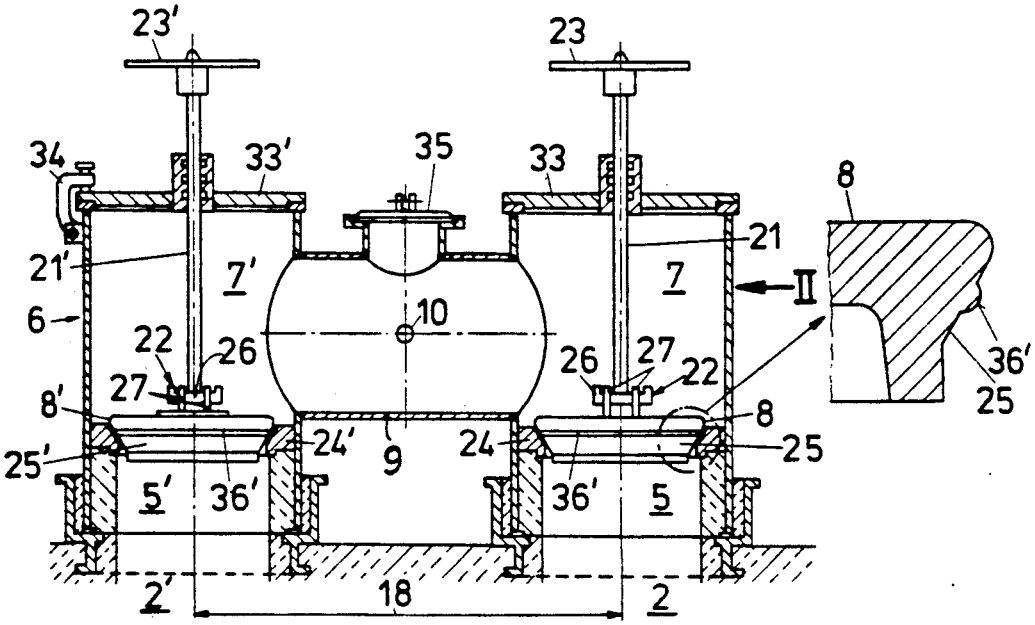

METHOD AND APPARATUS FOR REMOVING FILLING GASES FROM COKE OVENS

BACKGROUND OF THE INVENTION

This invention relates to a stationary gas jumper arrangement for a coke oven composed of adjacently arranged coke oven chambers each having a gas opening, which gas jumper arrangement overlaps gas openings of two adjacent coke oven chambers by one lid chamber each, the two lid chambers being connected in a duct-like manner by a jumper pipe and lids covering the gas openings during filling of a coke oven chamber being displaceable from an opened position into a closed position and settable into a rotational movement within the lid chambers by an actuation means.

DESCRIPTION OF THE PRIOR ART

A gas jumper arrangement of this type is known from DE-C-32 04 991. It serves to transfer the filling gases forming during filling of one coke oven chamber into the adjacent coke oven chamber. To seal the lids closing the gas openings relative to the rims of the gas openings, water-filled annular immersion trays are provided, into which annular lid aprons externally arranged on the lids project. The lid comprises a cylindrical stopper part reaching into the gas opening.

In order to be able to remove cakings formed at the gas openings, which might impede the insertion of the cylindrical stopper part of the lid, scrapers are arranged on the external circumference of the cylindrical stopper part, which, in placing on a lid, clean the gas opening by rotation of the lid so that the cylindrical stopper part will be insertable into the gas opening.

In practice, it has proved that the sealing of the lids does not meet the demands set, the more so as the immersion trays may be sucked empty on account of pressure fluctuations caused by high-pressure suction or even by the filling procedure. The immersion trays may as well be pressed empty at an overpressure. In this case, the water will get either onto the ceiling of the oven or into the coke oven chamber, forming large coal and coke deposits in and at the gas openings and on the internal side of the gas jumper arrangement by admixing with coal dust. Undesired moistening of the refractory brick lining of the coke oven chambers may also occur, which is disadvantageous.

From German Patent No. 1,105,380, a gas jumper arrangement movable at the oven is known, which is positioned above the lids of the coke oven chambers to be connected only during the gas transfer. A vapor nozzle runs into the gas jumper arrangement, through which the filling gases are sucked off and delivered. After a coke oven chamber has been filled or emptied, the gas jumper arrangement is moved on such that the lids of the first-connected coke oven chamber are freely accessible from above.

From U.S. Pat. No. 4,207,145 a stationary gas jumper arrangement is known, which is provided with flaps, which flaps are opened during the coking process and are closed only during emptying of a chamber, in which case inert gas is admitted to the gas jumper arrangement.

OBJECT OF THE INVENTION

It is the object of the present invention to further develop the known gas jumper arrangement with a view to largely suppressing coal and coke deposits and to ensuring the tightness of the gas openings even in case of larger pressure fluctuations. In particular, inertion of the gas jumper arrangement is to be feasible with the lids closed, without affecting the tightness of the lids relative to the gas openings.

SUMMARY OF THE INVENTION

In accordance with the invention, this object is achieved in that both each lid and the rim of each gas opening include annular valve face type sealing surfaces that mate with each other and are pressed at each other in the closed position of the lid, and that a feed line for an inert gas, such as nitrogen, runs into the gas jumper arrangement, wherein an inert gas pressure prevails within the gas jumper arrangement with the lids closed which is in excess of the pressure prevailing within the coke oven chambers.

On account of the mating sealing surfaces, tightness is ensured by mechanically acting sealing means.

Due to the rotational movement of the sealing surfaces relative to each other during placing of the lid, a particularly good fit of the sealing surfaces relative to each other is attained such that an excellent tightness will be ensured. The gas jumper arrangement is capable of being pressurized with inert gas, the overpressure being dimensioned in excess of the pressure prevailing within the coke oven chamber, thus avoiding any escape of oven gas, which constitutes a further safety factor. An additional advantage of inertion is that explosions are prevented as the lid is opened. Moreover, efficient protection against corrosion by the condensates incurring on the internal side of the gas jumper arrangement is provided by the inert gas.

A particular advantage of the arrangement according to the invention is to be seen in that, due to the use of mechanically sealed lids, the overall dimensions of the gas jumper arrangement can be kept very low, i.e., are only slightly larger than the diameters of the lids, which constitues a decisive improvement in respect of the very limited space conditions present on the ceiling of the coke oven.

An advantageous embodiment is characterized in that the sealing surfaces are designed in the manner of frustoconical envelopes, the sealing surfaces of the lids or of the rims of the gas openings each comprising an annular sealing ledge. Thus, a particularly tight fit is ensured.

In order to enable an easy cleaning of the stationarily arranged gas jumper arrangement without having to remove the gas jumper arrangement from the coke oven—from which results the tight connection of the gas jumper arrangement with the oven ceiling—, each lid chamber is provided with a detachable chamber lid on its upper side and a lifting means is arranged at the coke oven in a manner displaceable to any of the coke oven chambers for lifting the lids commonly with the chamber lids.

Suitably, the lifting means is displaceable along rails horizontally arranged on the coke oven and comprises a pivotable as well as liftable and lowerable cantilever beam capable of being coupled to a lid.

For reasons of safety, it is suitable if the gas jumper arrangement is provided with a bleeder valve.

A method for filling a coke oven chamber of a coke oven provided with a gas jumper arrangement is characterized in that two adjacent coke oven chambers, which are connected together by a gas jumper pipe in a duct-like manner and of which one is being filled, are set under negative pressure and the filling gases are sucked off directly from the coke oven chamber to be filled and through the gas jumper pipe from the adjacent coke oven chamber, and that air is aspirated through an opening provided in the vicinity of the gas jumper arrangement.

By the aspiration of air, the oxygen contained therein burns with part of the filling gases such that no deposits of tar condensates, coal, graphite, etc. will form in the interior of the gas jumper arrangement. This burning out of the gas jumper arrangement brings about a high purity of the sealing surfaces of the lids and of the gas openings such that perfect mating of these sealing surfaces and, thus, reliable sealing after closure of the lid are ensured.

The opening provided in the vicinity of the gas jumper arrangement advantageously is a leveller opening, through which a leveller bar is laterally introducible into the coke oven chamber, levelling off the tops of the conical coke piles in order that they do not impede the gas flow within the coke oven chamber.

In the following, the invention will be explained in more detail by way of one embodiment illustrated in the accompanying drawings.

DESCRIPTION OF THE DRAWINGS

FIG. 1 is a section through part of the ceiling of a coke oven including a gas jumper arrangement mounted thereto and likewisely illustrated in section;

DETAILS OF THE INVENTION

Figure 2:
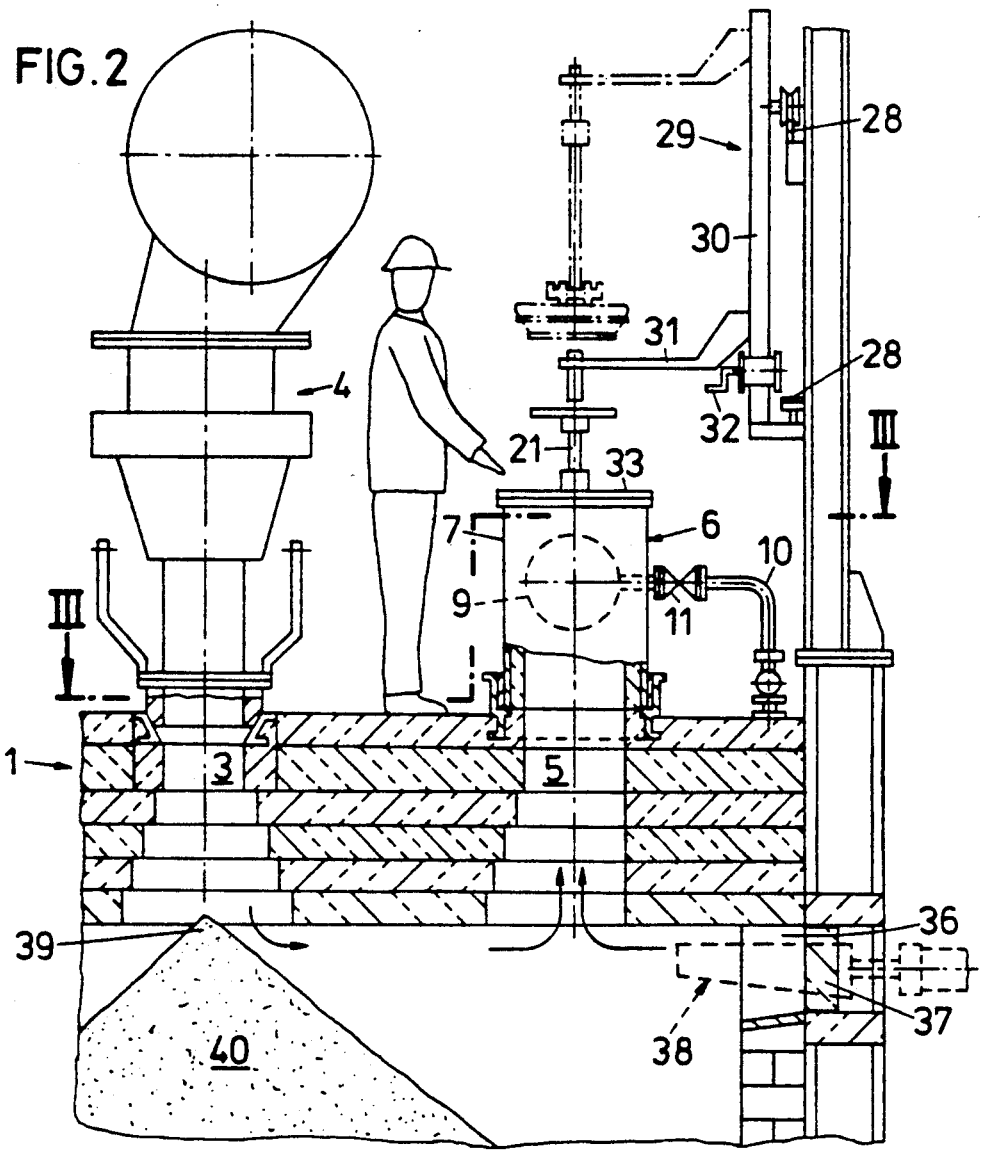
FIG. 2 is a partially sectioned side view in the sense of arrow II of FIG. 1.
Figure 3:
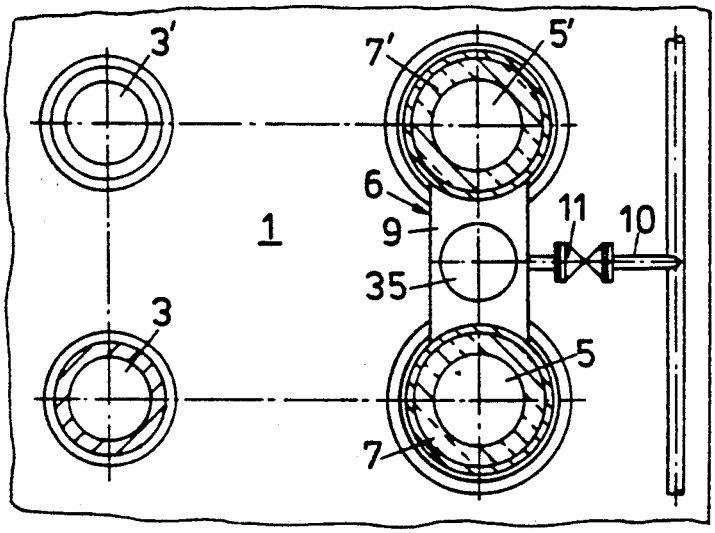
FIG. 3 is a section along line III—III.

On the ceiling 1 of a coke oven comprising adjacently arranged coke oven chambers 2, 2', . . . there are provided, for each coke oven chamber, a filling opening 3, 3', . . . to which a filling car 4 for filling the coke oven chamber with coking coal is connectable, as well as a gas opening 5, 5', . . . through which oven gas urged out of the coke oven chamber during filling may escape. In order to be able to convey the oven gas into the adjacent coke oven chamber 2', a gas jumper arrangement 6 is arranged on the gas openings 5, 5' of two adjacent coke oven chambers 2, 2', being supported on the oven ceiling 1 and connecting the gas opening 5 of one coke oven chamber 2 with the gas opening 5' of the adjacent coke oven chamber 2' in a duct-like manner.

The gas jumper arrangement 6 is comprised of two cylindrical and vertically directed lid chambers 7, 7', whose internal diameters are slightly larger than the external diameters of lids 8, 8' placeable on the gas openings 5, 5' such that the lids 8, 8' are vertically movable from an opened position into a closed position coaxially within the lid chambers 7, 7'.

The bottom ends of the lid chambers 7, 7' are firmly and gas-tightly mounted to the ceiling 1 of the coke oven. The lid chambers 7, 7' allocated to two adjacent coke oven chambers 2, 2' communicate with jumper pipe 9 extending transverse to the lid chambers 7, 7'. An inert gas duct 10 opens into the jumper pipe 9 and is controllable and lockable by means of a valve 11.

An actuation means 12 (cf. FIG. 1) serves to lift and place the lids 8, 8'; according to the exemplary embodiment illustrated, it is mounted to the filling car 4, which is displaceable all along the coke oven from filling opening 3 to filling opening 3'. This actuation means 12 comprises a frame 15, which is displaceable on a cross beam 13 of the filling car 4 in the horizontal direction by means of a pressure medium cylinder 14 and carries a cross beam support 16 on its lower end, which is liftable and lowerable by means of an additional pressure medium cylinder 17 mounted to the frame 15 on the one hand and to the support 16 on the other hand.

The cross beam carries two electromagnets 19, 19' arranged at a spaced-apart interval 18 from the adjacent gas openings 2, 2' and capable of being set in rotation by an electromotor 20, 20' each. The liftable and lowerable lids 8, 8' each are fastened to a lifting rod 21, 21' by means of a rotational drive type fastening 22, 22', the lifting rod 21, 21' projecting into the interior of the lid chamber 7, 7' from above. To the external side end of each lifting rod 21, 21' a steel plate 23, 23' is fastened at which the electromagnet 19, 19' may be set.

The configuration of the fit of the lids 8, 8' on the rims of the gas openings 5, 5' is of a particular relevance. To obtain a tight fit, both the lids 8, 8' and the rims of the gas openings 5, 5' have annular sealing surfaces 24, 24', which mate with sealing surfaces 25, 25', which are designed with a frustoconical envelope in the manner of a valve face, the sealing surfaces 25, 25' of the lids 8, 8' also including an anuular sealing ledge 36'. By lowering the lid 8, 8' and simultaneously turning the same, the annular sealing ledge 36' is pressed at the annular sealing surfaces 24 and 24', resulting in a perfectly tight fit. Each rotational drive type connection 22, 22' is formed by a transverse web 26 mounted to the lifting rod 21, 21' in a rotationally fast manner and retaining the lid 8, 8' by means of U-shaped shackles 27 overlapping the free ends of the transverse web; hence, the lid 8, 8' is connected with the lifting rod 21, 21' in a rotationally fast manner, yet it has a certain lateral play of movement to enable the safe centering of the sealing surfaces 24, 25 and 24', 25', respectively, getting into contact with each other.

In order to safeguard the tightness of the lids 8, 8' on the gas openings 5, 5' over an extended period of time, it is necessary to clean the sealing surfaces 24, 25, 24', 25' at predetermined time intervals. Since the degree of contamination is relatively low, this is the most simply effected manually. To this end, the lids 8, 8' must, however, be removed from the gas jumper means 6. A lifting means 29 (cf. FIG. 2) serves this purpose, being displaceable and accessible to all of the gas jumper arrangement 6 along rails 28 that extend all along the coke oven in the horizontal direction.

The lifting means comprises a vertical standard 30, along which a horizontally directed cantilever beam 31, which is pivotable about a vertical axis, is adjustable in height by means of a crank handle 32. The lifting rod 21, 21' and, thus, the lid 8, 8' can be coupled to this cantilever beam 31 in a manner that the lid 8, 8' is liftable into the position illustrated in FIG. 2 by dot-and-dash lines, together with the lifting rod 21, 21'. Before lifting off the lid 8, 8', a chamber lid 33, 33' provided on the upper end of each lid chamber 7, 7' must be removed. The chamber lids 33, 33' are detachably fastened to the respective lid chamber 7, 7' by means of clamps 34. After having lifted the lids 8, 8' out of the lid chambers 7, 7', also the jumper pipe 9 is readily accessible for cleaning.

In order to prevent damage by unpredictable explosions, a bleeder valve 35 is provided on the jumper pipe 9.

In the narrow side wall of each coke oven chamber 2, 2', . . . an opening designed as a leveller opening 36 and closeable by a door 37 is provided. A levelling pusher 38 schematically illustrated in FIG. 2 is insertable into the coke oven chamber 2, 2', . . . from aside through this leveller opening 36 to level off the tops 39 of the conical coke piles 40 forming below the filling openings 3, 3', . . . during filling. Thus, it is prevented that the gas flow within the coke oven chambers 2, 2', . . . will be impeded by these conical coke piles 40.

During filling of one coke oven chamber 2, 2', . . ., a negative pressure generated by a high-pressure suction means (not illustrated) is applied to the same and to the adjacent coke oven chamber 2, 2', . . . communicating with the former via the gas jumper arrangement, filling gases, thus, being drawn off the chamber to be filled and off the adjacent chamber through the gas jumper arrangement. Due to this negative pressure, air is additionally aspirated through the leveller opening 36, the filling gases, thus, partially burning with the oxygen of the aspirated air when flowing through the gas jumper arrangement.

Thereby, possibly formed deposits cakings (tar condensates, coal, graphite, etc.) are burnt off and a tight fit of the lids 8, 8' on the sealing surfaces 24, 24' surrounding the gas openings 5, 5' is ensured.

In addition to the fact that all of the emissions are sucked off during the filling procedure, the lids 8, 8' with their pertaining sealing surfaces 25, 25' and the corresponding matable sealing surfaces 24, 24' of the gas openings 5, 5' are rendered substantially maintenance-free.

What we claim is:

1. A method of filling a coke oven chamber of a coke oven comprised of adjacently arranged coke oven chambers each having a gas opening by using a stationary gas jumper arrangement including two lid chambers each disposed over a respective gas opening of two adjacently arranged coke oven chambers and each containing a coke oven chamber lid for covering said gas openings and uncovering said gas openings during filling of one of said coke oven chambers, said two lid chambers being connected together by a duct in the form of a gas jumper pipe, actuating means for moving each of said coke oven chamber lids from an opened position to a closed position on said gas openings during which each of said chamber lids is rotationally fitted to said gas openings, wherein each of said gas openings is characterized by an annular rim having sealing surfaces and each of said coke oven chamber lids has sealing surfaces which mate with said rims to provide a tight fit with each other in the closed position, wherein a gas feeding duct is connected to said gas jumper pipe for supplying inert gas into said gas jumper pipe when the coke oven chamber lids are closed against the rims of said gas openings and wherein a closable air opening means is provided in each of said coke oven chambers near the gas jumper pipe, said method comprising;

filling a first one of said two adjacent coke oven chamber with coal and thereby generating filling gases;

placing said two adjacent coke oven chambers under negative pressure;

removing part of the filling gases by suction directly from said first one of said two adjacent coke oven chambers and removing another part of the filling gases by suction from the second one of said two adjacent coke oven chambers by transfer through said gas jumper arrangement while aspirating air through the air opening means of the first one of said two adjacent coke oven chambers for combustion with said another part of the filling gases during transfer so as to prevent carbonaceous deposits from forming on the interior of the gas jumper arrangement.

2. In a stationary gas jumper arrangement combined with a coke over comprising adjacently arranged coke oven chambers, each having a gas opening extending through the ceiling of each of said oven chambers, said stationary gas jumper arrangement being adapted to overlap the gas openings of two adjacent oven chambers and comprising annular rims mounted on the ceilings of said oven chambers and peripherally surrounding and defining a gas opening bore coextensive with each of the gas openings and lid chambers mounted on the ceilings of the oven chambers and coaxially surrounding each of the annular rims, each of said lid chambers having a coke oven chamber lid coaxially and rotatably supported therein and configured so as to cover said gas opening bore when fitted against the annular rim, actuation means for vertically moving and rotating said coke oven chamber lids within said lid chambers, and a gas jumper pipe extending between and interconnecting the lid chambers of said two adjacently arranged coke ovens; the improvement comprising:

annular sealing surfaces provided on each of said coke oven chamber lids which mate with corresponding annular sealing surfaces provided on the rims defining said gas opening bores, such that when the chamber lids are brought into contact with and rotated against the annular sealing surfaces of said rims, tight seals are obtained, and a gas feeding duct coupled to said gas jumper pipe for supplying inert gas under pressure when the coke oven chamber lids are brought down into sealing contact with the annular rims.

3. The gas jumper arrangement as set forth in claim 2, wherein the annular sealing surfaces of each of said coke oven chamber lids and the annular sealing surfaces of said rims have mateable frustoconical configurations.

4. The gas jumper arrangement as set forth in claim 2, wherein said gas jumper pipe has a bleeder valve cooperatively associated therewith.

* * * * *